US005688012A

United States Patent [19]

Siesjo et al.

[11] Patent Number: 5,688,012

[45] Date of Patent: Nov. 18, 1997

[54] LAUNCHING DEVICE

[75] Inventors: Jan Siesjo; Anders Wigh, both of Linkoping, Sweden

[73] Assignee: Bofors Underwater Systems AB, Linkoping, Sweden

[21] Appl. No.: 601,028

[22] PCT Filed: Aug. 23, 1994

[86] PCT No.: PCT/SE94/00764

§ 371 Date: Apr. 1, 1996

§ 102(e) Date: Apr. 1, 1996

[87] PCT Pub. No.: WO95/05992

PCT Pub. Date: Mar. 2, 1995

[30] Foreign Application Priority Data

Aug. 24, 1993 [SE] Sweden ..... 9302720

[51] Int. Cl.[6] ..... B66C 1/28

[52] U.S. Cl. ..... 294/82.32; 294/82.24; 294/110.1

[58] Field of Search ..... 294/82.24, 82.31, 294/82.32, 82.33, 82.36, 86.27, 86.28, 86.29, 66.1, 66.2, 110.1

[56] References Cited

U.S. PATENT DOCUMENTS

| | | | |
|---|---|---|---|
| 2,537,829 | 1/1951 | Hohler | 294/82.32 |
| 3,285,650 | 11/1966 | Dukes | 294/82.32 |
| 3,853,082 | 12/1974 | Rosenberg et al. | 294/82.32 |
| 4,130,313 | 12/1978 | Clifford | 294/82.32 |
| 4,518,186 | 5/1985 | Hörnberg | 294/82.24 |

FOREIGN PATENT DOCUMENTS

| | | | |
|---|---|---|---|
| 151613 | 1/1985 | Norway . | |
| 464298 | 4/1991 | Sweden . | |
| 2214158 | 8/1989 | United Kingdom | 294/82.32 |

OTHER PUBLICATIONS

Derwent's Abstract, No. 84–138920/22, Week 8422, Abstract of SU 1039850 (Volf G L), 7 Sep. 1983.

*Primary Examiner*—Dean Kramer
*Attorney, Agent, or Firm*—Pollock, Vande Sande & Priddy

[57] ABSTRACT

A device in a lifting crane for releasing and recovering a load provided with a recovery cable comprises a lifting yoke having an aperture extending in a lifting direction of the lifting yoke, the recovery cable being slidable through the aperture; two locking members pivotally journalled in the lifting yoke about tangential axes of rotation, the locking members jointly capable of recovering and supporting a load while in a first position and, upon pivoting to a second position, releasing a supported load; and two regulating levers, one for each locking member, each regulating lever having a first end journalled on the axes of rotation of a respective locking member and a second end attached to a single biasing member, such as a spring interconnecting the pair of regulating levers, the pair of regulating levers, in combination with the spring, having an open position which forces the locking members to the second position for releasing a load and a closed position which, in combination with the spring, forces the locking members to the first position for recovering and supporting a load.

7 Claims, 6 Drawing Sheets

LAUNCHING DEVICE

TECHNICAL FIELD

The present invention relates to a device in a lifting crane for launching and recovering a load provided with a recovery cable, preferably a remote-controlled seagoing vessel. The device comprises a lifting yoke with through-holes in the direction of lift, through which holes the recovery cable of the vessel may slide and in the walls of the lifting yoke, movable locking means which are pivotally disposed to retain or release a lifting device mounted in the vessel (load) at the end of the recovery cable.

BACKGROUND OF THE INVENTION

More precisely, the device according to the present invention constitutes an improvement to an older design and construction intended for the same purposes. This prior art design and construction (which is described in Swedish patent No. 8703471-6) is, thus, intended for the launching and recovery of loads provided with recovery cables, such as remote-controlled seagoing vessels. In this instance, it comprises a lifting yoke provided with a through-hole in the direction of lift for the recovery cable and a number of pivotal locking means disposed to retain or release a lifting device mounted in the vessel at the end of the cable. However, in this design and construction the lifting yoke is operated by means of a first set of lines or wire ropes, while the locking means, which are pivotal about tangentially disposed shafts, are operated by means of a second set of lines or wire ropes secured in lever portions extending outside the lifting yoke and included in the locking means.

For switching this construction from the launching to the recovery position, displacement is necessary of the anchorage points of both sets of lines in relation to the lifting ring. As a result, this has been designed with an elongate portion along which the anchorage of the lines regulating the locking means may be displaced and manually locked in two different positions, one of which is the launching position and the other is the recovery position. In addition, it is necessary that the locking means, in connection with preparation for launching, are manually switched to the locked position before lifting of the seagoing vessel is activated in connection with launching. On the other hand, this design and construction affords the advantages of not requiring any controlled switching of the locking means when the vessel reaches the surface of the water during the launching process proper or during the recovery operation. The reason for this is that, during these operation sequences, the devices functions fully automatically as a result of the design of the locking means and the line anchorages.

Given the severe environments which this device is intended to operate including freezing temperatures and also given the risk of powerful corrosive attack, it has now been considered necessary within the art to simplify the switching from launching position to recovery position to the simplest possible manual operation and, in addition, to eliminate the potential risks of functional disturbance residing in the fact that the locking means are switched from the open position as a result of force of gravity in the form of simple ballast weights placed outermost on the lever portions of the locking means.

SUMMARY OF THE INVENTION

It has now proved possible through the present invention to satisfy these conditions in that the previous unlocking and locking function controlled by the cable of the locking means and by force of gravity has been replaced by a "spring bolt" readily switchable between launching and recovery positions and which has no loose parts. As a result of this design and construction modification, we have, moreover gained the advantage that the entire device has become considerably smaller, because it operates vertically in the recovery phase. Like the prior art design, this new device also operates fully automatically in both launching and recovering the vessel in question.

In the above-discussed prior art construction, the lifting ring was further designed as two separable halves in order to make it possible to pass in the recovery cable of the vessel from one side into a through-channel intended for this purpose. This separation possibility has now been replaced by a vertical groove running through the lifting housing in whose inlet portion a "port" in the form of a cylindrical rotary sleeve also provided with a groove is disposed. The recovery cable of the vessel may, thus, be moved from the side into the groove in the lifting housing to the innermost portion of the groove of the sleeve, whereafter the sleeve is rotated such that the recovery cable is locked in its groove. This design realizes a more stable and more resistant lifting unit than the prior art separable variation. The rotary sleeve may, for example, be produced from the plastic material acetal.

According to the present invention the locking means pivotally journalled about tangentially applied axes of rotation are united by means of a regulation function in the form of a spring-biased interconnection which, in response to the adjustment setting of the regulation function, actuates the locking means towards open position for launching and closed position for recovery, respectively, and it is possible, irrespective of the selected adjustment setting of the regulation function to force the locking means by the weight of the cargo or load and against the action of spring force over to the opposite position in order to be returned to the originally set position by spring force as soon as this actuation ceases.

In such instance, the regulation function preferably consists of two levers which are journalled with their inner ends in the axes of rotation of each respective locking means about transverse shafts disposed transversely of these axes of rotation and between whose free outer ends a drawing spiral spring is tensioned, while the locking means are fixedly secured at their axes of rotation, which in turn are movably journalled in the lifting housing. The levers and the locking means thus together form a rotationally rigid unit in which the angular positions of the levers in relation to the locking means may be varied between two end positions which make an angle of 180° with each other.

The switching operation between launching and recovery positions proceeds such that both of the levers are simultaneously rotated through 180° about their respective transverse axes. This implies that the spring loading for the rotation of the locking means for the rotation changes direction.

In order to prevent unintentional switching of the levers between the launching and recovery positions while the vessel is suspended in the lifting yoke, there are provided special locking devices which am automatic and cannot be cancelled out, for reasons of safety.

It is also conceivable to introduce locks which permit a switching of the levers only after a predetermined force has actuated them. In the locking devices which are currently under consideration, the switching from launching position to recovery position once the vessel has departed from the lifting yoke may be remote-controlled by means of a cable connection which, when it is stretched in the direction of the lifting cable, forces the levers to the upper position, i.e. to the position which corresponds to recovery position.

BRIEF DESCRIPTION OF THE ACCOMPANYING DRAWINGS

The present invention has been defined in the appended claims and will now be described in greater detail hereinbelow, with particular reference to the accompanying drawings. In the accompanying drawings:

Figure 3:
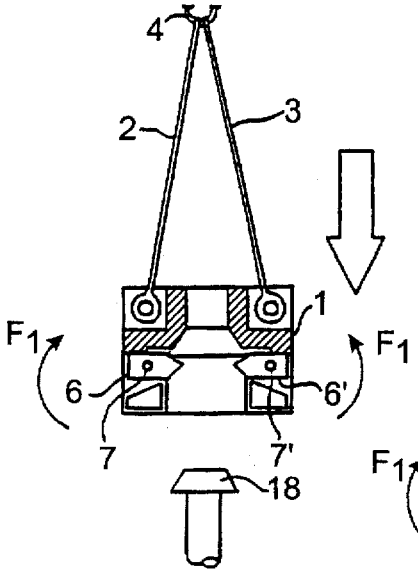
Figure 4:
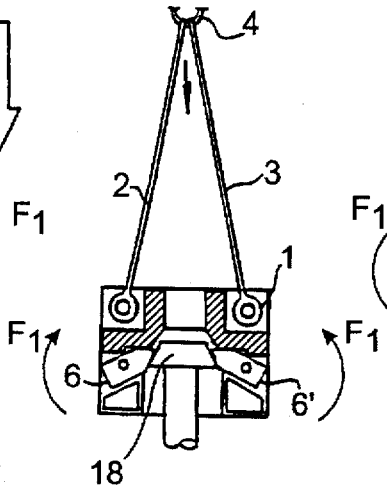
Figure 5:
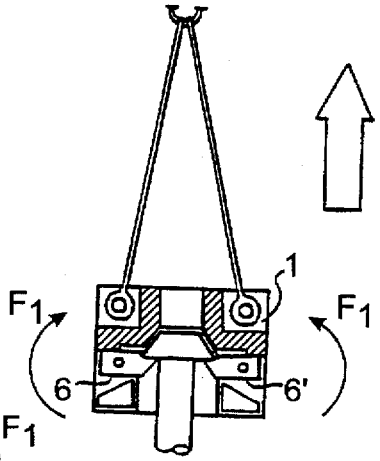
Figure 6:
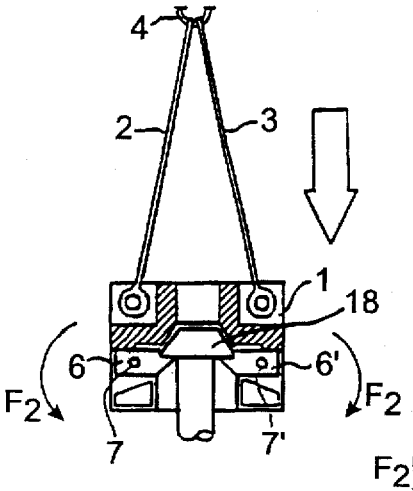
Figure 7:
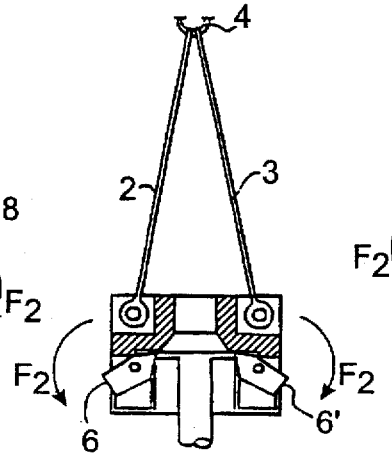
Figure 8:
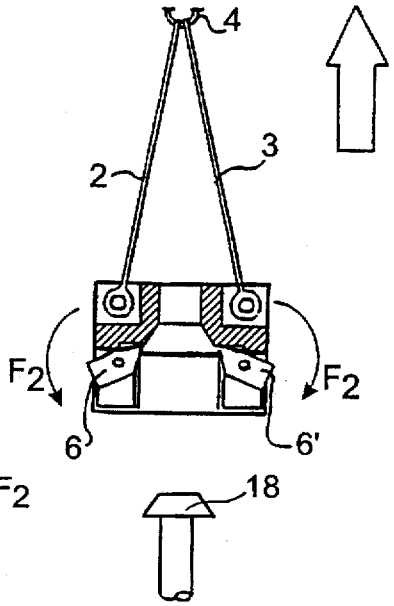
Figure 9:
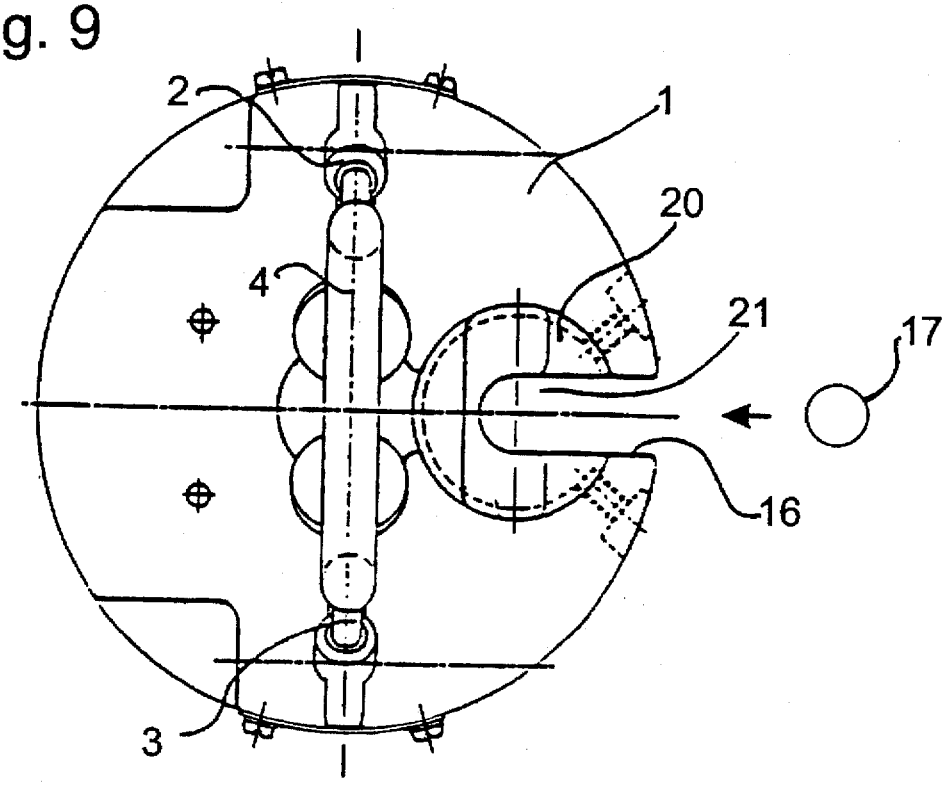
Figure 10:
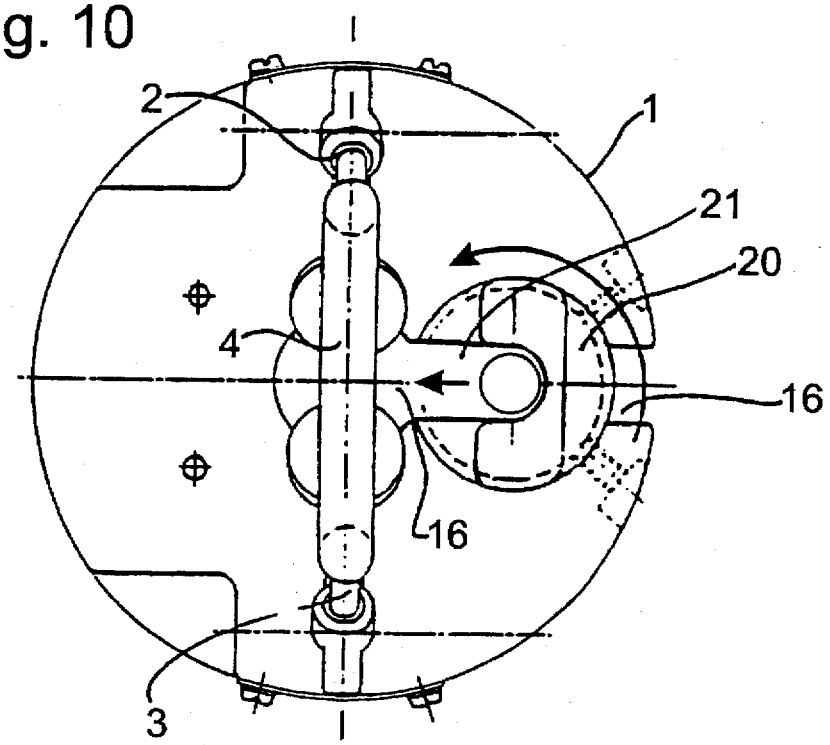
Figure 11:
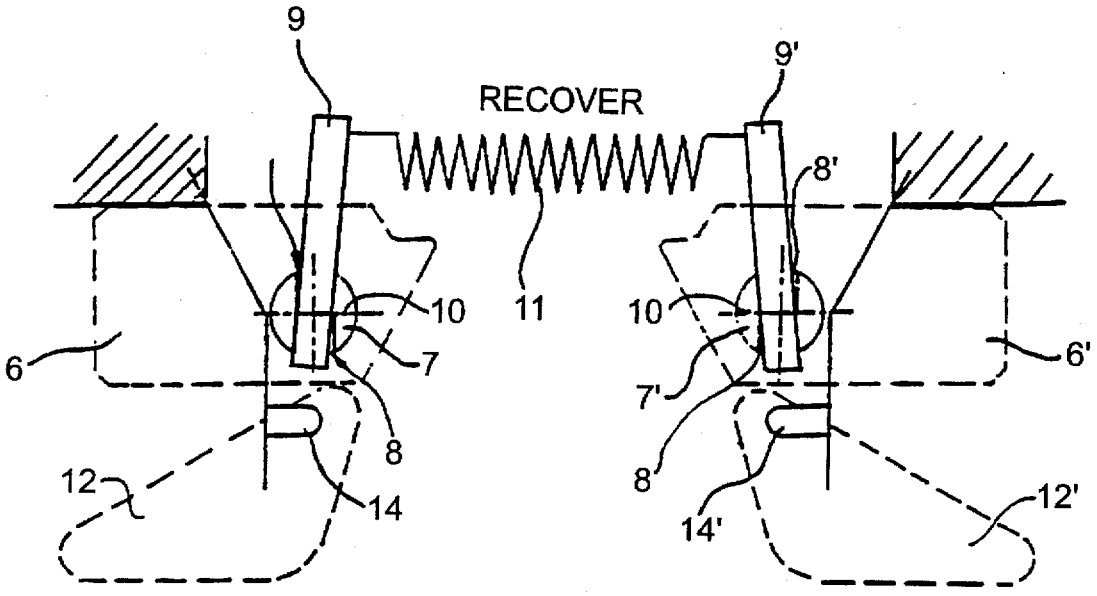
Figure 12:
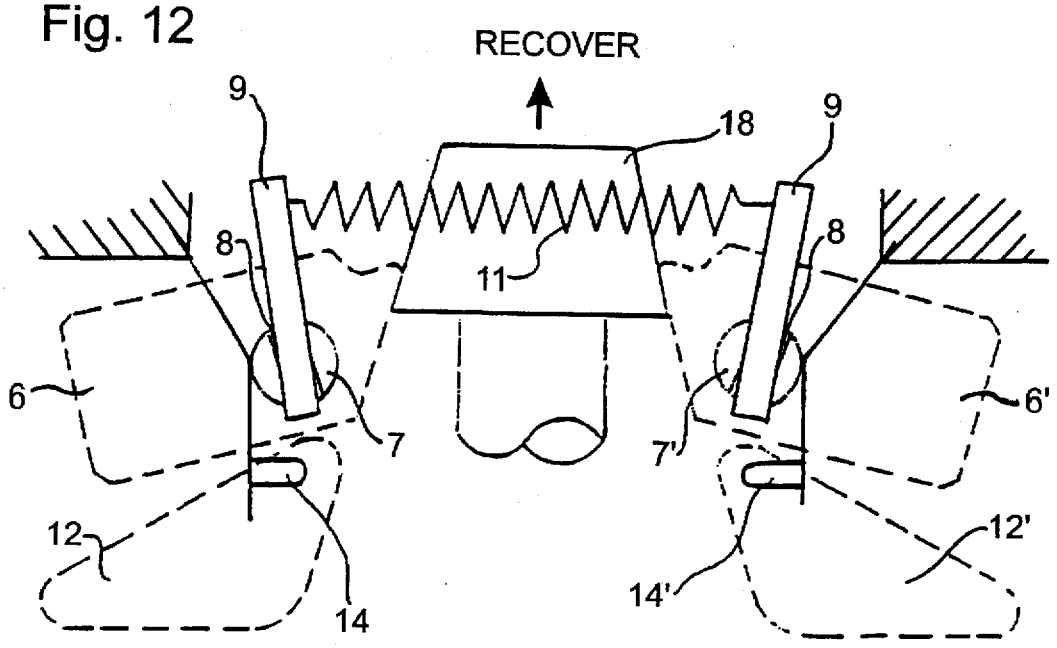
Figure 13:
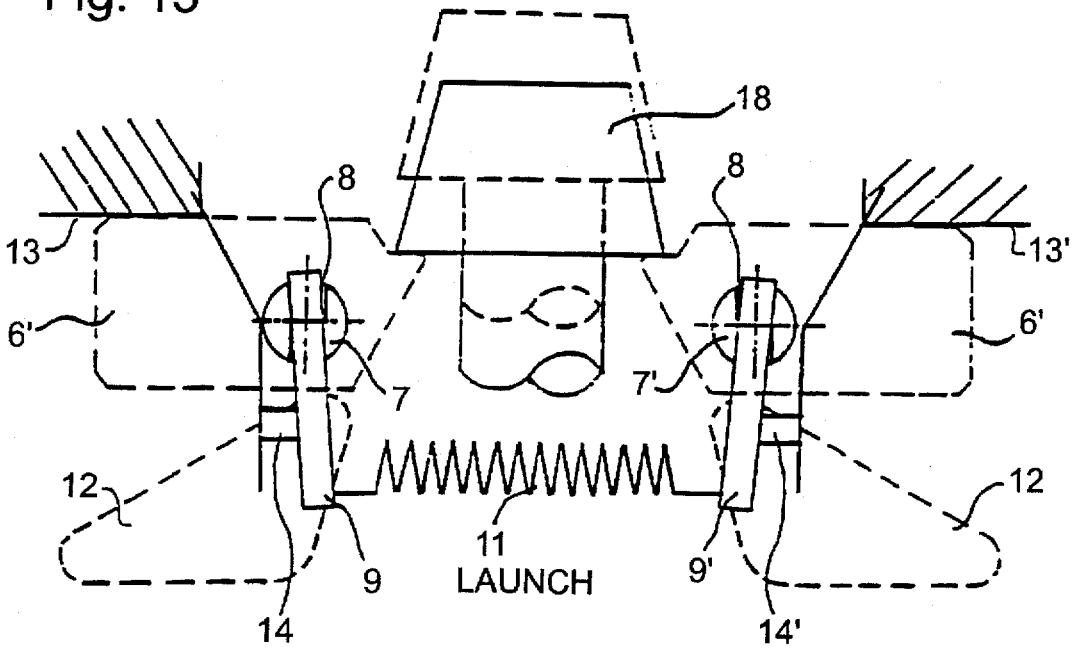
Figure 14:
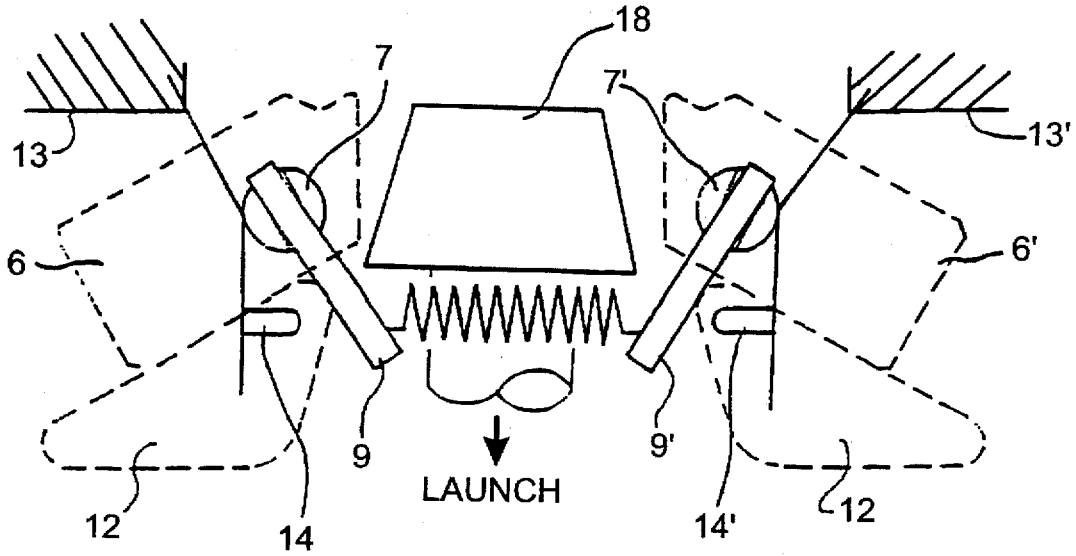

FIGS. 3–5 schematically illustrate three phases during recovery;

FIGS. 6–8 schematically illustrate three phases during launching;

FIGS. 9–10 show the function of the port;

FIGS. 11–12 show the parts of the vessel and their function during recovery; and FIGS. 13–14 show the parts of the vessel and their function during launching.

In the figure, corresponding parts are, to the extent they are included in the illustrations, provided with corresponding reference numerals.

DETAILED DESCRIPTION OF THE PREFERRED EMBODIMENT

Figure 1:
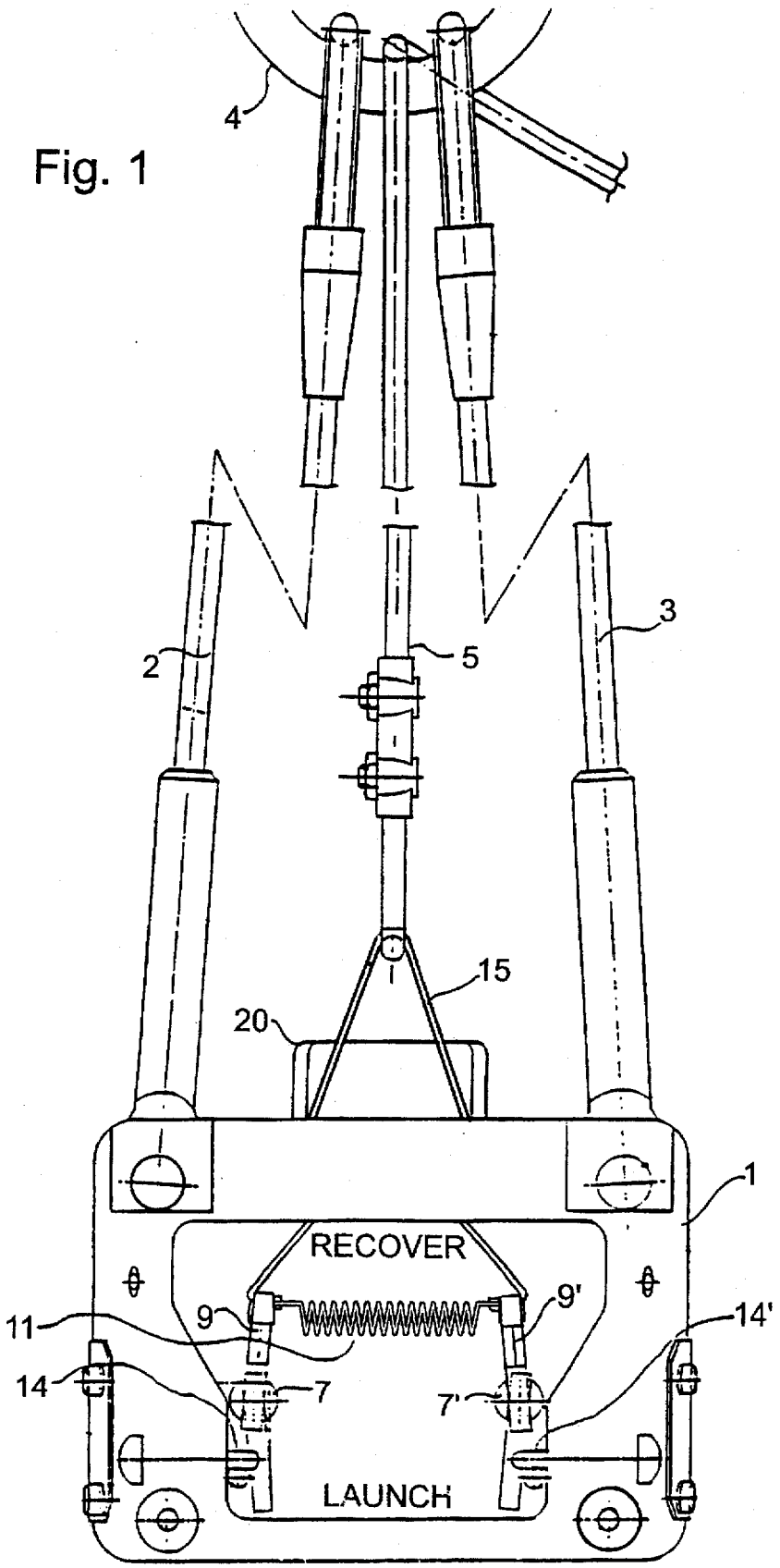
FIG. 1 is an overall illustration of the device seen from the side of the vessel.
Figure 2:
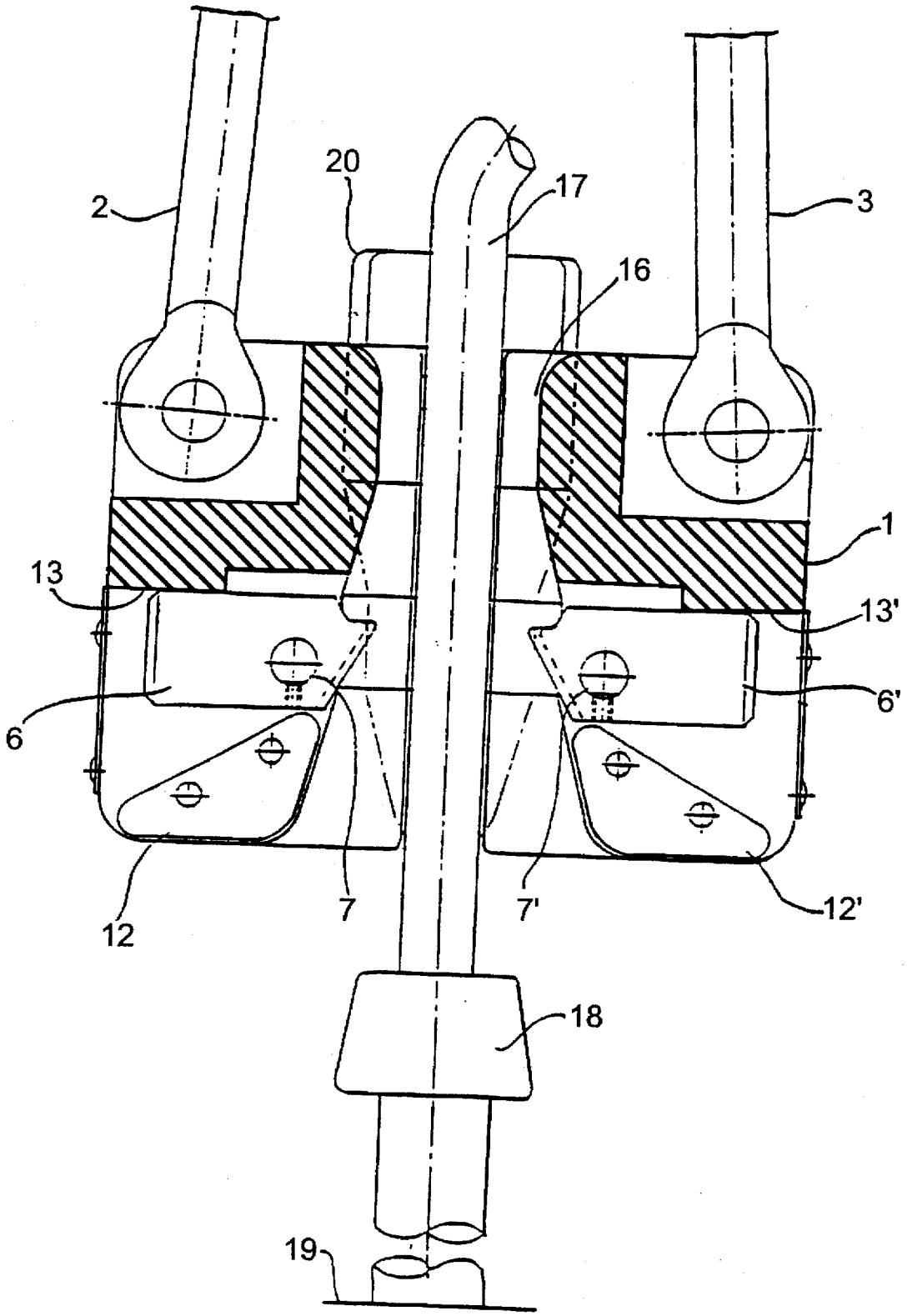
FIG. 2 is a section through the device with cable and lifting device.

The device illustrated in FIG. 1 and others consists of the lifting housing or lifting yoke 1 which is suspended in two lifting cables 2 and 3 collected in a lifting ring 4 of which only a part is shown on the figure. Through the lifting ring 4 there also runs an operating cable 5 to which we shall return later.

In the lifting yoke 1, two locking members 6 and 6' are further pivotally journalled with their respective axes of rotation 7 and 7' with which they each form their rigid construction. In the shaft ends of these axes of rotation projecting out through the wall of the lifting housing 1, two levers 9, 9' are rotatably journalled in grooves 8, 8' in each respective shaft end about transverse shafts 10, 10'. Rotation of the levers 9, 9' is 180°, i.e. in the illustrated example with the levers turned to face upwards or downwards. The free outer ends of the levers are united by means of a drawing spiral spring 11. As is primarily apparent from FIGS. 11 and 13, the shafts 10 and 10' make a certain angle with the longitudinal direction of the levers, i.e. the apertures through the levers intended for the shafts do not run at right angles through the levers. This is to give the levers the best angle in their respective positions. Consequently, the grooves 8, 8' have the special cross design shown on the figures which gives the levers abutment against the edges of the grooves only at those parts where the action of the spring 11 may be directly transferred to each respective axis of rotation 7, 7'.

Two arrest heels, 12, 12' are also provided in the lifting yoke and limit the movements of the locking members 6, 6' in the opening direction. In the closed position, the locking members abut with their rear ends, i.e. those ends which do not account for the locking function, against fixed abutment 13, 13' in the lifting yoke 1.

As was shown in FIG. 1 and in greater detail in FIGS. 11–14, the downwardly directed position of the levers is designated "launch" and their common upwardly directed position carries the designation "recover".

In order to lock the levers 9, 9' in the launch position until launching has been carried out, there are two resilient locks 14, 14' to which we will revert later. Mention was made earlier of the operating cable 5 which, via a cable connection 15, is connected to the free outer ends of the levers and is utilized for forcing over the levers 9, 9' from "launch" position to "recover" position.

A through aperture 16 runs through the lifting yoke 1 for the recovery cable 17. This latter is terminated in a lifting device 18 which is fixedly secured in the relevant load 19. The lifting devices in the form of a truncated cone whose smallest defining surface is turned to face upwardly. The aperture 16 is in the form of a groove open to one side. Around the groove and in the proximity of its inlet side, a cable port is provided in the form of a rotary sleeve 20, in the present case produced from acetal plastic. A groove 21 is similarly provided in this sleeve for the lifting cable. When the lifting cable is to be moved into place, the sleeve 20 is rotated so that its groove 21 is turned to face outwardly, the cable is moved into the groove 21 whereafter the sleeve is rotated through 180° and the cable is in place (see FIGS. 9 and 10).

When the device has been made ready for launching, the recovery cable 17 is in place in the groove or the aperture 16, the levers 9, 9' are in the "launch" position, i.e. turned to face downwardly and the lifting device 18 loads the locking members 6, 6' so that their rear portions abut against the arrest abutment 13, 13', i.e. the locking members are in the closed position even though the levers 9, 9' load the locking members to urge them in the opening direction. (See FIGS. 6–8 and 13, 14). As soon as the load reaches the water, the locking members are unloaded and the spring 11 draws the levers towards one another, whereupon the locking members open. As soon as the recovery cable 17 is released, contact between the load and the lifting yoke will then cease.

For this to operate, there must, thus, be clearance between the cone of the lifting device 18 and a corresponding cone in the lifting yoke, see FIGS. 5 and 13. Space available therebetween must be sufficient to allow the locking members to move away from the cone when this lifts.

By loading the cable 5, the device may now be switched to the recovery position. The levers 9, 9' are then switched over into "recover" position, i.e. facing upwards. In this instance, the locking members 6, 6' are influenced by the spring 11 in the closing direction (see FIGS. 3–5 and 11, 12). When the load reaches the lifting yoke 1 and the recovery cable 17 is tightened, the locking members are loaded by the upper portion of the lifting device 18 which, against the action of the spring 11, forces up the locking members so that the lifting device may pass. As soon as this has taken place, the locking device is closed, whereafter the load may be recovered simply by utilizing the lifting cables 2 and 3 of the lifting yoke and without any further loading of the recovery cable 17.

What we claim and desire to secure by Letters Patent is:

1. A device in a lifting crane for releasing and recovering a load provided with a recovery cable, said device comprising:

a lifting yoke having an aperture extending in a lifting direction of said lifting yoke, said recovery cable being slidable through said aperture;

two locking members pivotally journalled in the lifting yoke about tangential axes of rotation, said two locking members jointly capable of recovering and supporting a load while in a first position and, upon pivoting to a second position, releasing a supported load; and two regulating levers, each for controlling one of the locking members, each regulating lever having a first end journalled on the axis of rotation of a respective locking member and a second end attached to a single biasing means interconnecting said pair of regulating levers, wherein said pair of regulating levers, in combination with said biasing means, when in an open position, forces the locking members to said second position for releasing a load and when in a closed position, forces the locking members to said first position for recovering and supporting a load.

2. The device according to claim 1 wherein said locking members, while receiving a lifting anchor of said load in said first position, are forced partially open by said lifting anchor against action of the biasing means until said load reaches a support location at which time the locking members spring back into said first position.

3. The device as claimed in claim 1 wherein said regulating levers are jointly switchable between said open and closed positions by rotation about their respective transverse axis.

4. The device as claimed in claim 1 wherein said aperture for the recovery cable comprises a rotary grooved sleeve rotable between a first position, in which said recovery cable can be installed in said aperture and a second position in which said recovery cable is secured in said aperture.

5. The device as claimed in claim 1 further comprising locks in said lifting yoke for preventing said regulating levers from moving from said open position until the load has left the lifting yoke.

6. The device as claimed in claim 1 wherein said second ends of said regulating levers are connected to a cable which, when tightened, forces the levers from said open position to said closed position.

7. The device according to claim 1 wherein said biasing means is a drawing spiral spring.

* * * * *